United States Patent [19]

Matthews

[11] 4,107,816

[45] Aug. 22, 1978

[54] CLEANING HEADS

[75] Inventor: Paul William Matthews, Hadleigh, England

[73] Assignee: Babcock Kina Limited, Hadleigh, England

[21] Appl. No.: 753,470

[22] Filed: Dec. 22, 1976

[51] Int. Cl.[2] ..... A47L 7/00

[52] U.S. Cl. ..... 15/320; 15/322; 239/225

[58] Field of Search ..... 15/320, 321, 322, 345, 15/385; 239/225, 251

[56] References Cited

U.S. PATENT DOCUMENTS

| | | | |
|---|---|---|---|
| 3,222,707 | 12/1965 | Allenbaugh | 15/345 |
| 3,719,966 | 3/1973 | Lamont | 15/385 |
| 3,748,050 | 7/1973 | Poppitz | 239/251 X |
| 3,832,069 | 8/1974 | Petsch | 239/251 X |
| 4,037,290 | 7/1977 | Rose et al. | 15/345 |

*Primary Examiner*—Christopher K. Moore

*Attorney, Agent, or Firm*—Kemon & Estabrook

[57] ABSTRACT

This invention relates to a cleaning head and, more particularly, to a cleaning head traversable across a floor surface to direct a jet of cleaning water onto the surface.

1 Claim, 3 Drawing Figures

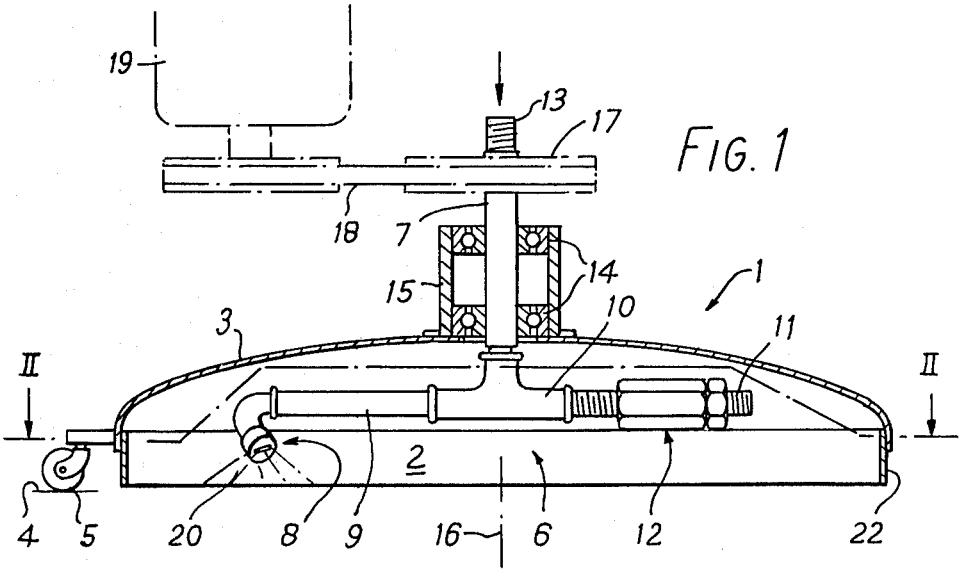
FIG. 1
FIG. 2
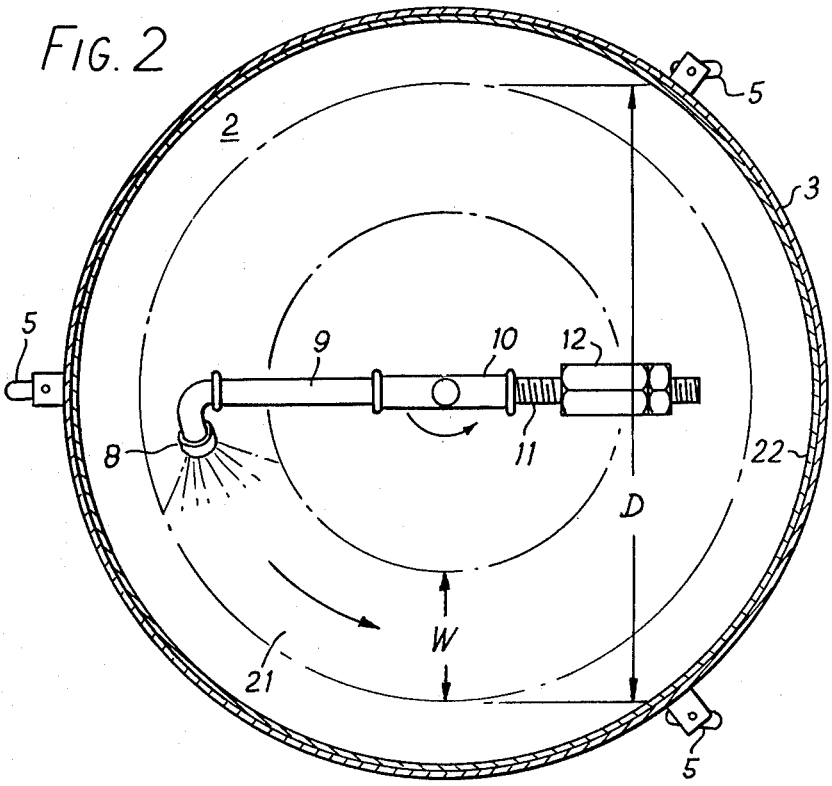

CLEANING HEADS

According to the present invention there is provided a cleaning head having a chamber open on one side and adapted to be movable relative to a surface to be cleaned with the open side adjacent the surface, a jet device, and means for rotating the jet device about an axis approximately perpendicular to the surface to be cleaned, the jet device having cleaning fluid discharge nozzle means radially spaced from the axis of rotation of the jet device disposed within, and directed towards said open side of, said chamber.

The invention will now be described, by way of example, with reference to the accompanying, partly diagrammatic, drawings, in which:

FIG. 1 is a section elevation of a cleaning head;

FIG. 2 is a view along the line II—II of FIG. 1; and

Figure 3:
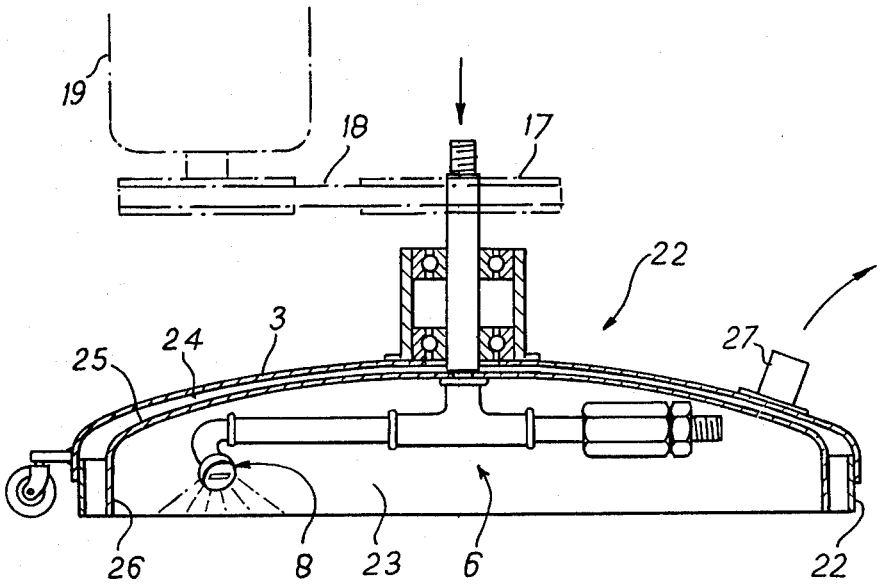
FIG. 3 is a sectional elevation of a modified arrangement of the head shown in FIGS. 1 and 2.

Referring to FIGS. 1 and 2 there is shown a cleaning head 1 having a chamber 2 formed by a circular dished casing 3 open at the base and movable over a floor surface 4 to be cleaned on externally mounted wheels 5.

A jet device 6 is mounted on the casing and includes a hollow stem 7, which extends through the top of the casing 3, a tangentially directed nozzle 8 provided at the end of a hollow arm 9 connected to the stem 7 by a tee-piece 10 which also carries an arm 11 having a radially adjustable balance weight 12 diametrically opposite the nozzle.

The end of the stem remote from the tee-piece forms an inlet 13 for the jet device provided with a coupling for connection to a supply of water for use in cleaning the surface 4.

The stem 7 is mounted in bearings 14, in a housing 15 secured to the casing 3, for rotation about a central axis 16. Drive means for rotating the jet device about its axis of rotation 16, shown in dotted out-line, include a pulley 17 secured to the stem 7 connected by a belt 18 to an electric motor 19. The casing 3 is provided with a peripheral rubber skirt 22 which helps to contain the cleaning fluid issuing from the nozzle within the head.

In operation, water is supplied through the inlet 13 to the jet device and issues as a fan shaped jet 20 from the nozzle. The jet device is rotated about its axis of rotation 16 by the drive means so that the jet 20 from the nozzle 8 impinges on the surface 4 over a substantially annular area 21 when the head is stationary. Upon moving the head over the surface 4 in a straight line the jet acts on a band of width D which corresponds substantially to the width W of the fan shaped jet together with twice the radial distance of the nozzle 8 from the axis 16. Thus the area cleaned in a single pass is greater than would be the case if the nozzle were stationary with the same configurations. In order for a stationary fan jet nozzle to act over the same area of the surface to be cleaned a relatively high setting above the surface must be utilised, which, for same inlet conditions results in the impact pressure of the jet being greatly reduced.

In addition, since the nozzle 8 is tangentially directed, the rotational speed of the device, which is approximately 1500 r.p.m., is superposed on the jet discharge velocity to increase the impact velocity of the jet on the surface to be cleaned.

The weight 12 is adjustable radially in dependence on nozzle outlet conditions dynamically to balance the jet device for smooth rotation.

The cleaning water is either hot or cold water, depending upon the condition of the surface to be cleaned, a solvent being added either to the surface prior to cleaning or to the water, if necessary.

In the modified arrangement shown in FIG. 3, an additional, outer, chamber 24 is formed between the casing 3 and a similar but smaller casing 25 nested therewithin and provided with a rubber skirt 26. The outer chamber 24 is provided with an outlet 27, which, in use, is connected to a source of vacuum for removing cleaning water and soils from the head. The provision of the outer chamber connected to vacuum in the modified head also helps to limit the passage of cleaning fluid and soils from the head under the skirt 22. Thus, the modified head is particularly suitable for use where excessive residual liquid has to be avoided on the surface being cleaned.

In a further modification (not shown) the electric motor drive is dispensend with and the rotation is achieved by virtue of the reaction of discharge of the jet. It will be appreciated that in such an arrangement the impact velocity of the jet is somewhat reduced.

I claim:

1. A cleaning head including a dished casing open at a base portion thereof, bearing means co-axially mounted on the dishes casing, a cleaning liquid supply tube axially rotatably extending though the bearing means and dished casing and connected to a source of cleaning liquid, a cleaning liquid supply arm extending radially from the cleaning liquid supply tube adjacent the base portion of the dished casing, a cleaning liquid discharge nozzle extending perpendicularly from the cleaning liquid supply arm adjacent the dished casing, means for rotating the cleaning liquid supply arm, means for dynamically balancing the cleaning liquid supply arm and means for movably supporting the dished casing with the base adjacent a surface to be cleaned, a first flexible skirt and a second flexible skirt mounted on the dished casing and extending toward the surface to be cleaned, with a region bounded by said first and second flexible skirts connected to exhaust means to produce a suction effect within the region relative to spaces external of the region both within the casing and outside the casing.

* * * * *